US005636816A

United States Patent [19]

Burton et al.

[11] Patent Number: 5,636,816

[45] Date of Patent: Jun. 10, 1997

[54] UNIVERSAL AIR CONDITIONER MOUNTING BRACKET AND METHOD

[75] Inventors: Stewart A. Burton, 51 Shea Ave., Milford, Conn. 06464; Robert R. Hellman, Jr., Oxford, Conn.

[73] Assignee: Stewart A. Burton, Milford, Conn.

[21] Appl. No.: 547,783

[22] Filed: Oct. 25, 1995

[51] Int. Cl.[6] ..... A47H 33/00

[52] U.S. Cl. ..... 248/208; 62/262; 248/674

[58] Field of Search ..... 248/678, 208, 248/351; 62/262; 454/204

[56] References Cited

U.S. PATENT DOCUMENTS

| | | | |
|---|---|---|---|
| 1,512,792 | 10/1924 | Nelson | 248/236 X |
| 2,717,139 | 9/1955 | Jewell | 454/204 X |
| 2,880,952 | 4/1959 | Moore et al. | 248/208 |
| 2,935,284 | 5/1960 | Reeves | 248/208 |
| 3,273,843 | 9/1966 | Bell, Jr. et al. | 248/208 |

*Primary Examiner*—Ramon O. Ramirez
*Attorney, Agent, or Firm*—John H. Crozier

[57] ABSTRACT

In a preferred embodiment, a mounting bracket for support of a window air conditioner on a window sill installed in a window opening in a wall of a building, the bracket including: a generally horizontal support member for supporting a portion of the window air conditioner extending outside of the building, a proximal end of the generally horizontal support member being for attachment to the window sill; a foot member to rest against an outside surface of the wall below the window opening; a strut member having an upper end thereof attached to an attachment point near a distal end of the generally horizontal support member and a lower end thereof attached to the foot member; and apparatus to selectively adjust height of the proximal end of the generally horizontal support member above the window sill, depending on construction of the window sill and obstacles in the window.

17 Claims, 7 Drawing Sheets

UNIVERSAL AIR CONDITIONER MOUNTING BRACKET AND METHOD

BACKGROUND OF THE INVENTION

1. Field of the Invention

The present invention relates to the installation of window air conditioners generally and, more particularly, but not by way of limitation, to novel mounting bracket and method for supporting such air conditioners which are simple, and which bracket can be installed entirely from inside a building and can be folded essentially flat for convenient storage.

2. Background Art

Window air conditioners are widely used for cooling selected portions of buildings. A problem with mounting and supporting such air conditioners is that windows, window sills, storm window/screen frames, and building walls are furnished in a myriad of sizes and configurations. Because of this, window air conditioners are frequently sold with instructions to provide an external support, but no support is furnished with the air conditioner. It is left to the installer to fashion some type of suitable support and, often, the installation of the support requires working on the exterior of a building from a ladder or elevated surface. Sometimes, fasteners must be inserted into the exterior surface of the building wall, thus creating a possible site for water leakage and/or decay.

In cases where some type of support is supplied with the air conditioners, the supports often require attachment to the exterior surface of the building wall. A further disadvantage of such supports is that they fail to adequately isolate, from the building structure, vibrations caused by operation of the air conditioners.

Accordingly, it is a principal object of the present invention to provide bracket and method for supporting window air conditioners that are simple and that can be utilized to mount such air conditioners in a wide range of configurations and sizes of windows, window sills, storm window/screen frames, and building walls.

A further object of the present invention is to provide such a mounting bracket that is economical to construct.

An additional object of the present invention is to provide such a mounting bracket that can be conveniently stored.

Another object of the present invention is to provide such a bracket that does not require the insertion of fasteners into the exterior surface of a building wall.

Yet a further object of the present invention is to provide such a mounting bracket that provides adequate vibration isolation.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a mounting bracket for support of a window air conditioner on a window sill installed in a window opening in a wall of a building, said bracket comprising: a generally horizontal support member for supporting a portion of said window air conditioner extending outside of said building, a proximal end of said generally horizontal support member being for attachment to said window sill; a foot member to rest against an outside surface of said wall below said window opening; a strut member having an upper end thereof attached to an attachment point near a distal end of said generally horizontal support member and a lower end thereof attached to said foot member; and means to selectively adjust height of said proximal end of said generally horizontal support member above said window sill, depending on construction of said window sill and obstacles in said window.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
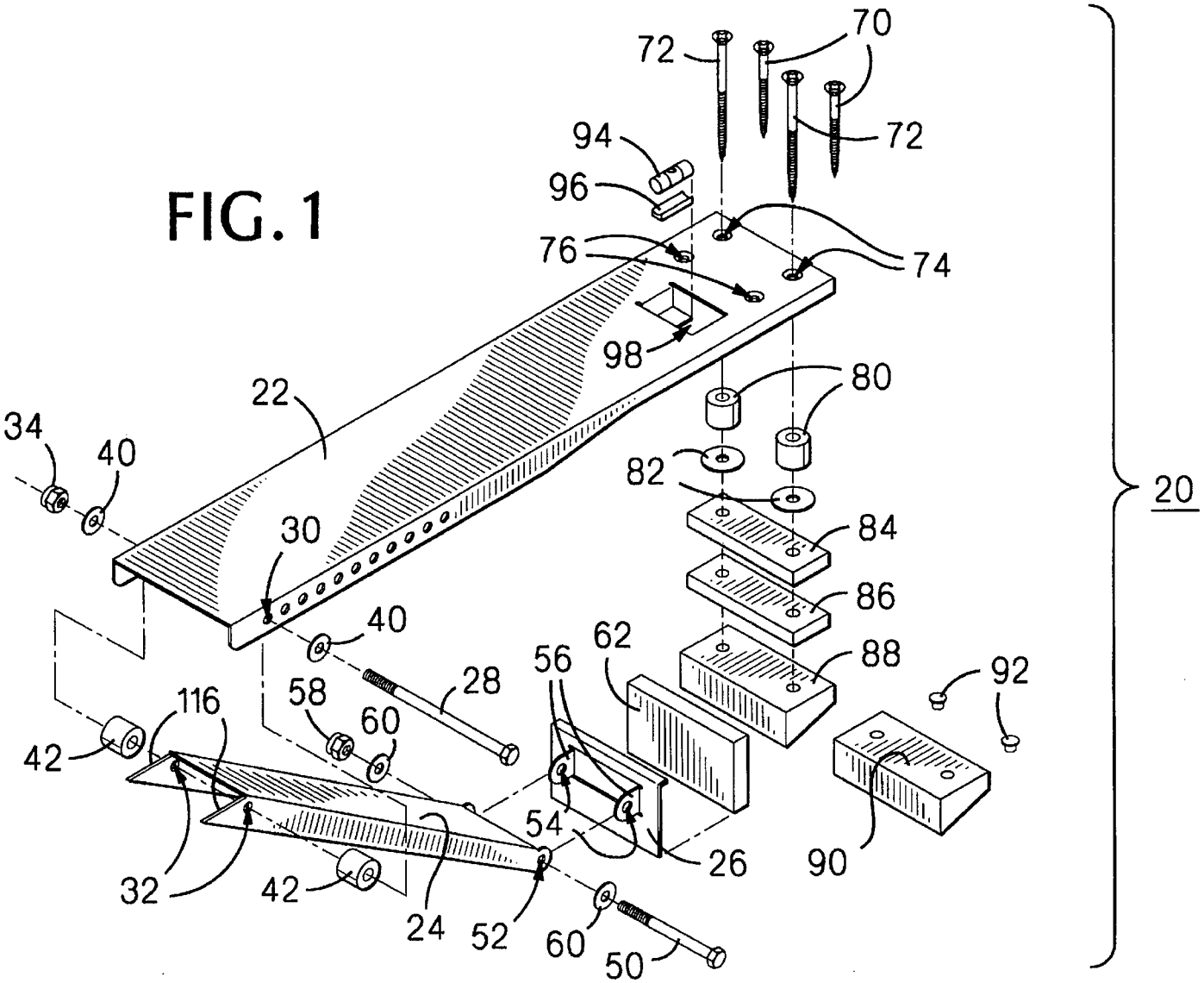
FIG. 1 is an exploded, isometric view of a window air conditioner mounting bracket constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a window air conditioner mounting bracket constructed according to the present invention, and generally indicated by the reference numeral 20.

Bracket 20 includes a horizontal support member 22 on which a window air conditioner (not shown on FIG. 1) may be placed. A strut member 24 angles between the distal end of horizontal support member 22 and a generally vertical foot member 26. The upper end of strut member 24 is attached to the distal end of horizontal support member by means of a bolt 28 inserted through a selected pair of a plurality of pairs of aligned holes, as at 30 (only one hole visible on FIG. 1), defined through side edges of horizontal support member 22 and a pair of aligned holes 32 defined through side edges of strut member 24, the bolt being tightened in place with a non-loosening aircraft nut 34. Two flat washers 40 are disposed on bolt 28 against the outer surfaces of the side edges of horizontal support member 22 and two nylon spacers 42 are disposed on the bolt between the inner surfaces of the edges of the horizontal support member and the outer surfaces of the edges of the strut member. The lower end of strut member 24 is attached to foot 26 by means of a bolt 50 inserted through a pair of aligned holes 52 (only one hole visible on FIG. 1) defined through the side edges of the strut member and a pair of holes 54 defined through flanges 56 fixedly disposed on the front surface of the foot. A non-loosening aircraft nut 58 is provided to secure bolt 50 in place. Two flat washers 60 are disposed against the outer surfaces of the side edges of strut member 24. A resilient, vibration isolation pad 62 is fixedly secured by suitable means to the rear surface of foot 26, which pad also serves as a "non-skid" pad.

The proximal end of horizontal support member 22 is attached to a window sill (not shown) by means of a selected pair of two pairs of wood screws 70 and 72 inserted through a selected pair of two pairs of holes 74 and 76 defined through the proximal end of the horizontal support member, which of the pairs of screws and holes selected depending on the configuration of the window sill. One of the pairs of screws 70 and 72 is inserted through one of the pairs of holes 74 and 76, then through a pair of nylon spacers 80, through a pair of fender washers 82, through one or both of two resilient vibration isolation pads 84 and 86, through one of two wedge blocks 88 and 90, and into the window sill. The lower edge of wedge block 88 is cut at 20 degrees from horizontal and the lower edge of wedge block 90 is cut 15 degrees from horizontal, the two angles reflecting the downward slopes of the majority of window sills.

A pair of hole plugs 92 is provided for insertion in holes (not shown) made in the window sill to exclude water and insects when bracket 20 is removed for winter storage.

A spirit level 94 and mounting plate 96 are disposed in a cavity 98 defined in the upper surface of horizontal support member 22.

Figure 2:
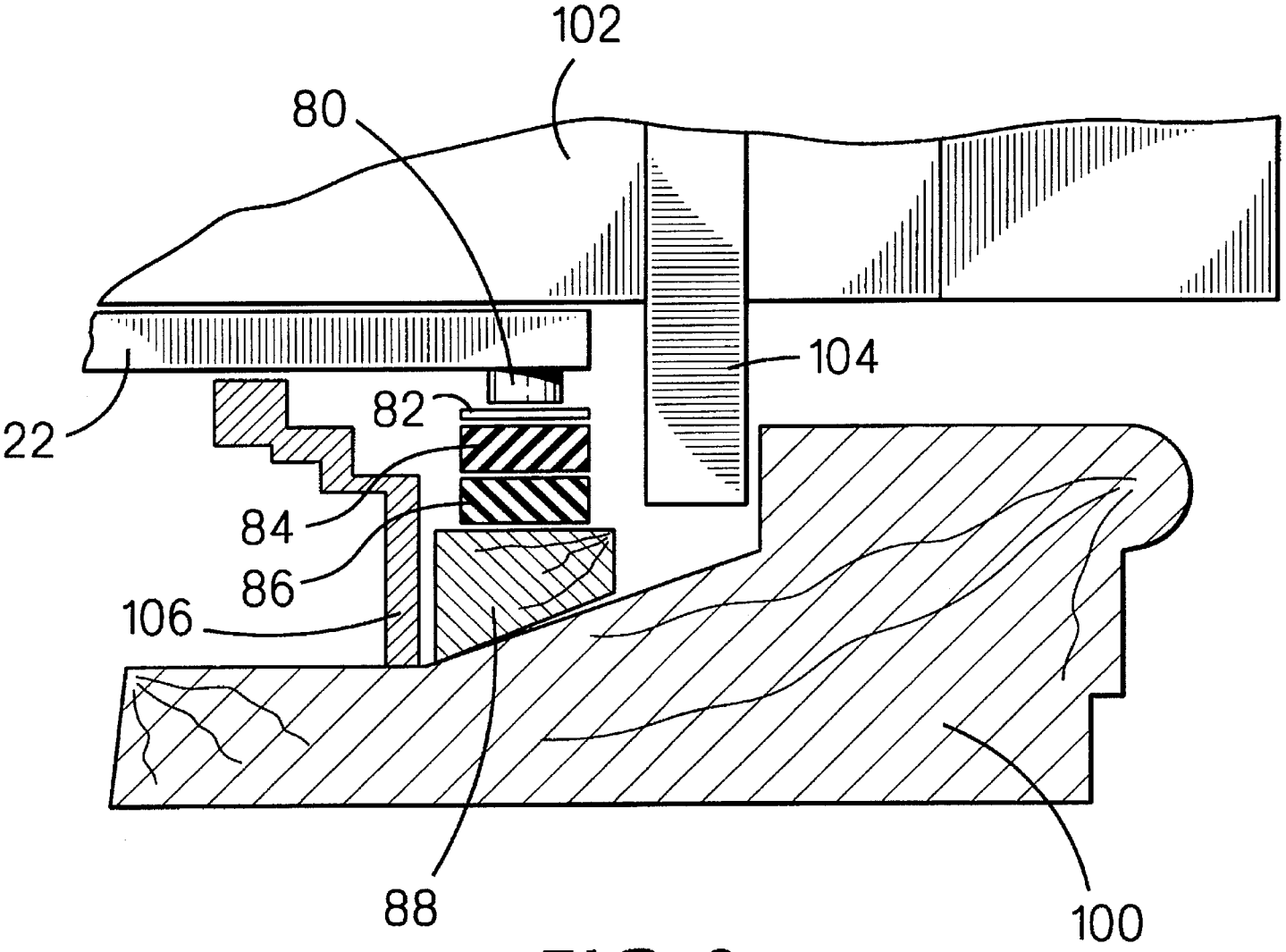
FIG. 2 is a fragmentary, side elevational view, partially in cross-section, of the bracket of FIG. 1 mounted on a window sill and supporting a window air conditioner.

FIG. 2 illustrates the proximal end of bracket 20 mounted to a window sill 100, the bracket supporting a window air conditioner 102. Window air conditioner 102 includes a flange 104 disposed therearound which fits, in part, against the outer surface of the upper part of window sill 100. A storm window/screen frame 106 is mounted in the window opening of which window sill 100 is a part. In this installation, both vibration isolation pads 84 and 86 have been used so that horizontal support member 22 will clear the upper edge of storm window/screen frame 106. Were storm window/screen frame shorter or nonexistent, it can be seen that one or the other of vibration isolation pads 84 and 86 could be eliminated, as could spacers 80, providing that flange 104 had sufficient clearance from the sloped portion of window sill 100. Wedge block 88, having a 20 degree angle from horizontal, is employed in this installation.

Figure 3:
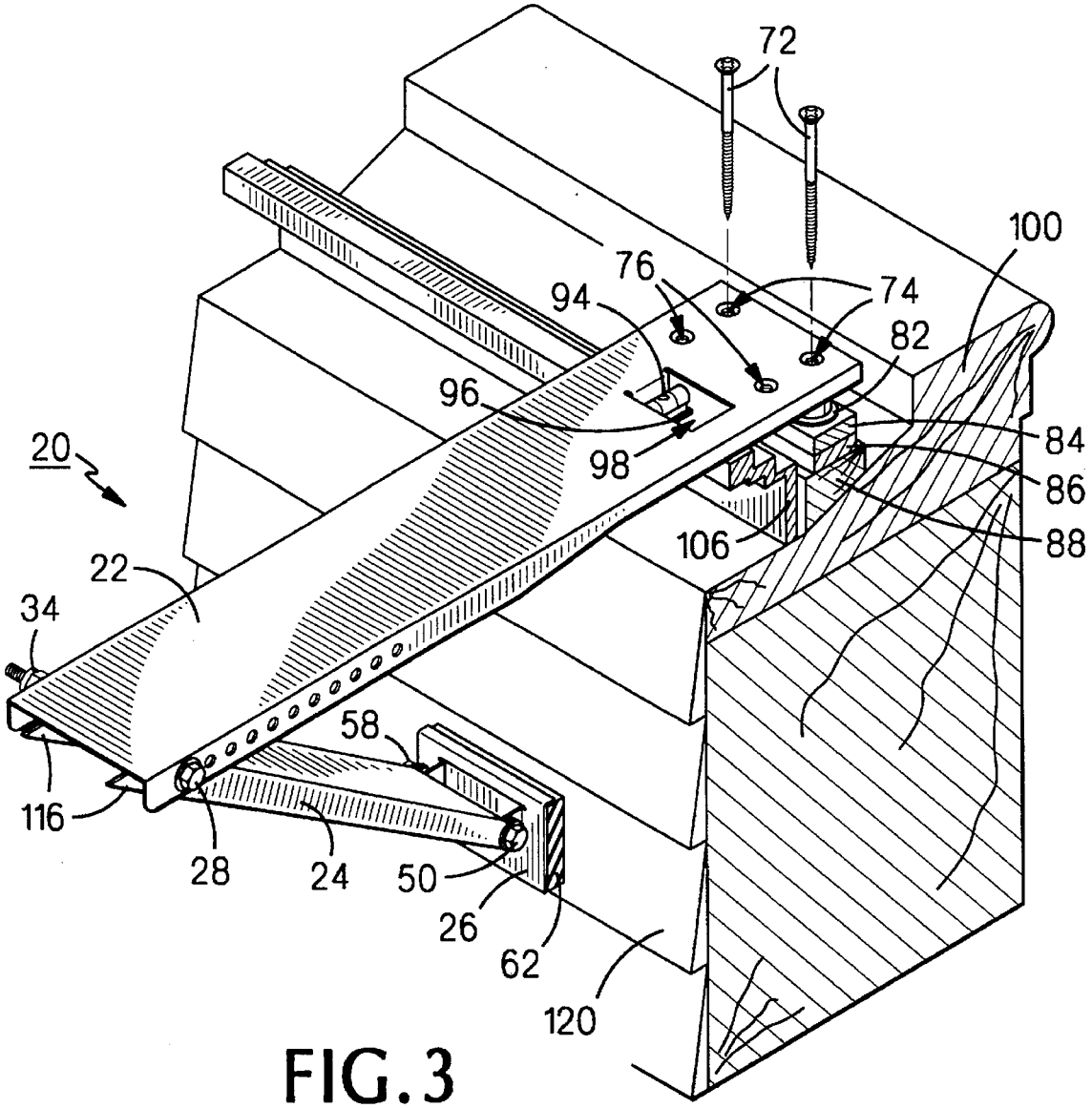
FIG. 3 is an isometric view of the bracket of FIG. 1 mounted on a building.

FIG. 3 illustrates the complete installation of bracket 20, with its proximal end attached to window sill 100 (FIG. 2), and with vibration isolation pad 62 against the outer surface of a wall 120 in which the window sill is installed. The longer screws 72 have been employed in this installation, since both isolation pads 84 and 86 are included.

Figure 8:
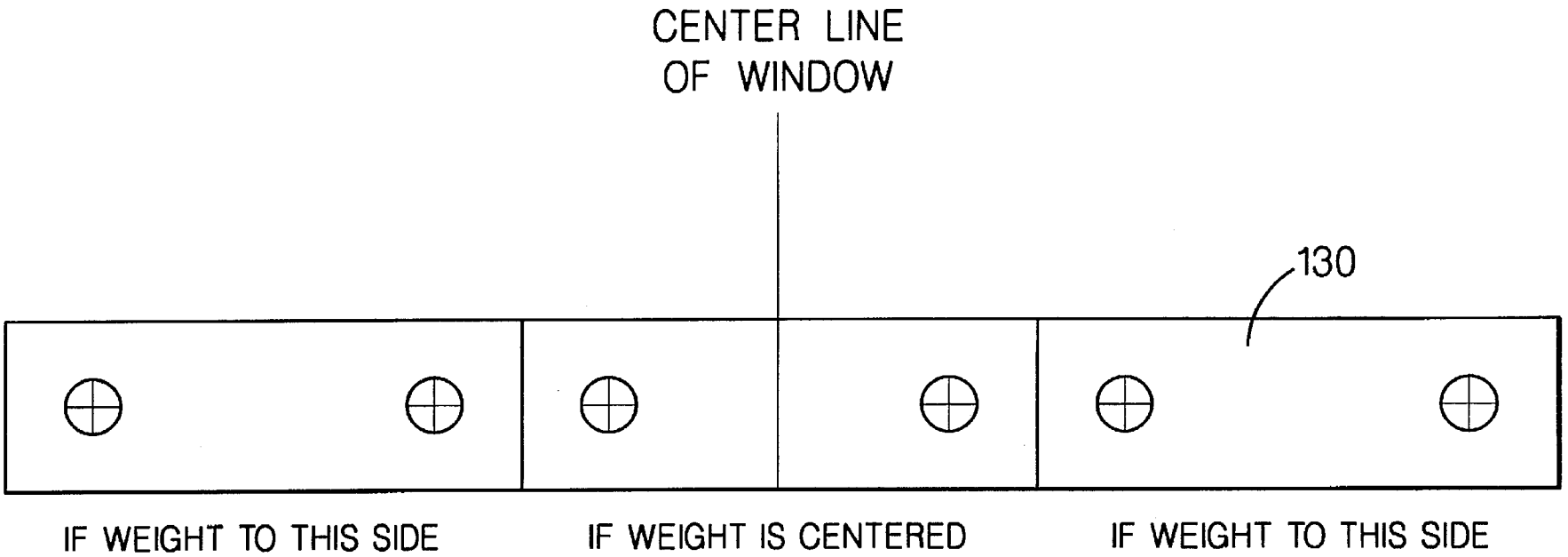
FIG. 8 is a template to be used when installing the bracket of FIG. 1.
Figure 9A:
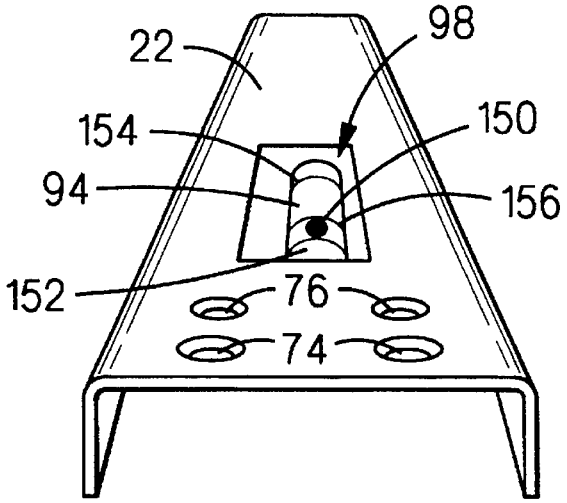
FIGS. 9(*a*)–9(*d*) are fragmentary perspective views showing the use of a level indicator on the bracket of FIG. 1 in setting the angle of the support member of the bracket.
Figure 9B:
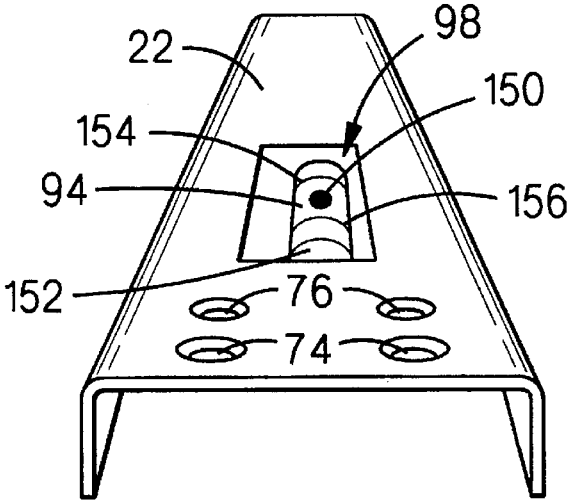
Figure 9C:
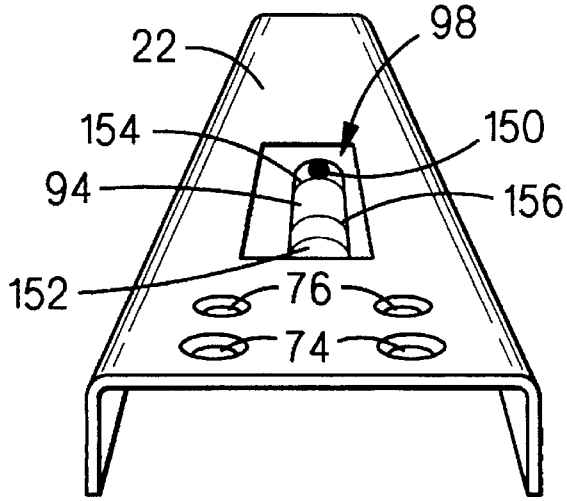
Figure 9D:
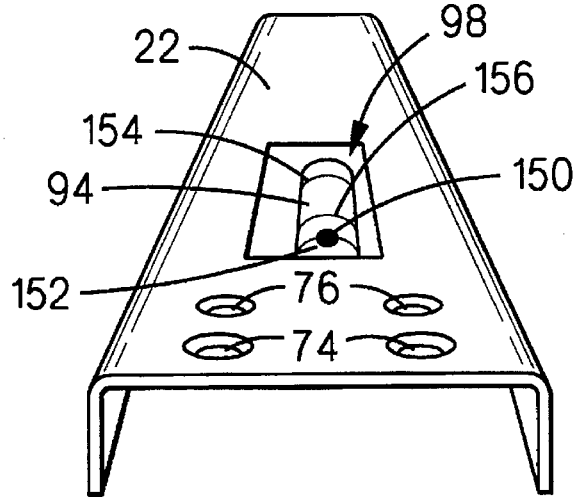

To install bracket 20, one first assembles horizontal support member 22, strut member 24, and foot 26 as indicated on FIG. 1 and then determines which side, if any, of window air conditioner 102 (FIG. 2) is heaviest. This may be done by visual inspection—the heavy compressor is usually mounted to one side—or by lifting each side and judging the relative weights thereof. Then, using the template on FIG. 8, the proper pair of holes is located on window sill 100 and appropriate size holes are drilled in the window sill.

Next, the proper combination of screws 70 and 72, holes 74 and 76, spacers 80, vibration isolation pads 86 and 88, and wedge blocks 88 and 90 is selected, in view of the construction of the window and any obstructions therein such as storm window/screen frame 106 (FIG. 2).

Window air conditioner 102 must be angled slightly downwardly from wall 120 (FIG. 3) to allow condensation to drip from the rear of the air conditioner. If the manufacturer suggests an angle, then that angle should be set by selecting the appropriate pair of holes 30 in the side edges of horizontal support member 22 to provide that angle in the horizontal support member. If there is no suggested angle, then spirit level 94 may be employed to set an angle, as indicated by reference to FIGS. 9(*a*)–9(*d*). First, strut member 24 is connected to horizontal support member 22 through an intermediate set of holes 30 (FIG. 1) and the strut member is then permitted to rotate downwardly until it stops by virtue of beveled ends 116 (FIG. 3) of the upper ends of the side edges of the strut member engaging the lower surface of horizontal support member 22. Then, selected ones of pairs of screws 70 and 72 (FIG. 1) are loosely inserted through the selected elements and into window sill 100 (FIG. 2). Now, bracket 20 is allowed to pivot downwardly until vibration isolation pad 62 on foot 26 engages wall 120 (FIG. 3).

Referring to FIGS. 9(*a*)–9(*d*), spirit level 94 includes a bubble 150 floating in a liquid contained in an elongated, clear tube 152. Spirit level 94 also includes a first line 154 disposed across tube 152 toward the distal end thereof and a second line 156 disposed across the tube toward the proximal end thereof. After placing assembled bracket 20 in the position indicated above, reference is made to spirit level 94. If bubble 150 is just over line 156, as indicated on FIG. 9(*a*), horizontal support member 22 (FIG. 3) will be at the appropriate angle. If bubble 150 is between lines 154 and 156 or over line 154, as indicated on FIGS. 9(*b*) and 9(*c*), respectively, then bolt 28 should be moved toward the distal end of horizontal support member one set of holes 30 at a time, until the bubble is as indicated on FIG. 9(*a*). If bubble 150 is well past line 156, then bolt 28 should be moved toward the proximal end of horizontal support member 22 on set of holes 30 at a time, until the bubble is as indicated on FIG. 9(*a*). It will be understood that the correct pair of holes 30 is ultimately determined by the thickness of the building wall and that the provision of a number of pairs of holes accommodates a wide range of building wall thicknesses.

After the correct angle of horizontal support member 22 is determined and set, nuts 34 and 58 are tightened, screws 72 or 74 are tightened until vibration isolation pads 84 and 86 are evenly compressed slightly, window air conditioner 102 (FIG. 2) is mounted on the horizontal support member, and other, conventional operations for installation of the air conditioner completed.

All the above operations can be completed from within the building.

Figure 4:
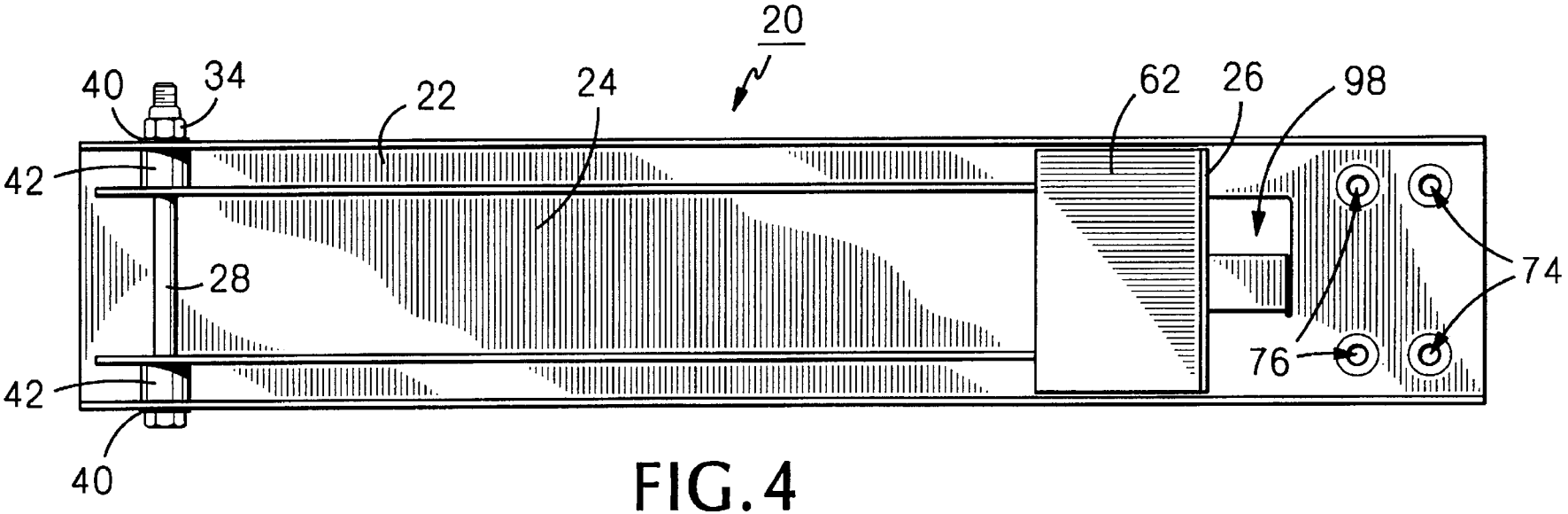
FIG. 4 is bottom plan view of the bracket of FIG. 1 in folded position.
Figure 5:
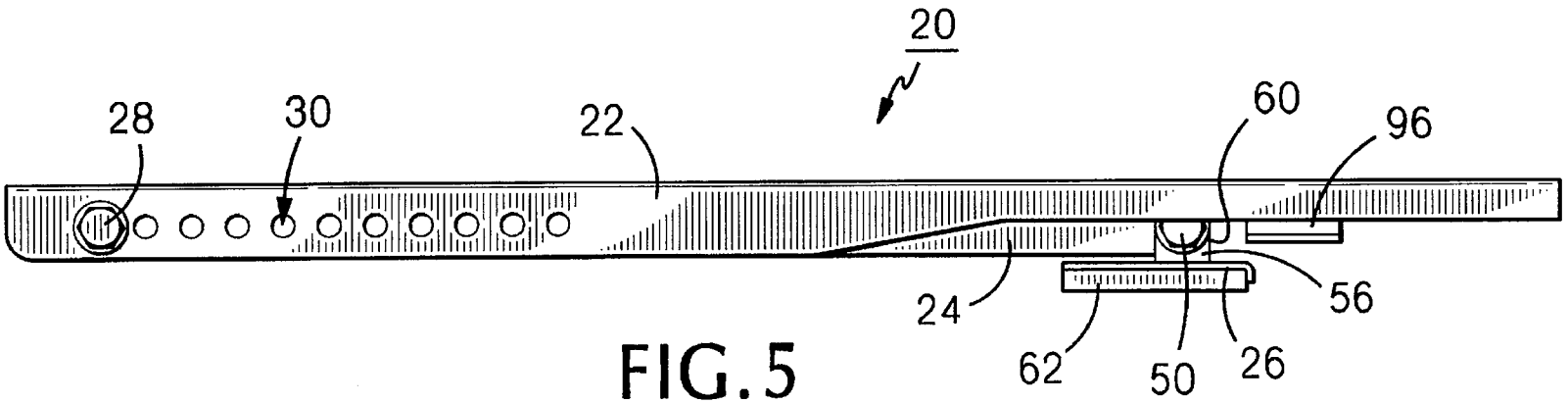
FIG. 5 is a side elevational view of the bracket of FIG. 1 in folded position.

FIG. 4 and 5 illustrate an important aspect of the present invention, that of bracket 20 being foldable into a compact arrangement when it is desired to store or transport the bracket. Loosening of nuts 34 and 58 permits foot 26 to be folded flat against strut member 24 and permits the strut member to be folded flat against the inner surface of horizontal support member 22 (FIG. 5). Nuts 34 and 58 may then be lightly retightened to secure the foregoing elements in place. Bracket 20, compactly folded, can be conveniently packaged for sale along with the other elements of the bracket in kit form, or can be conveniently stored in winter.

Figure 6:
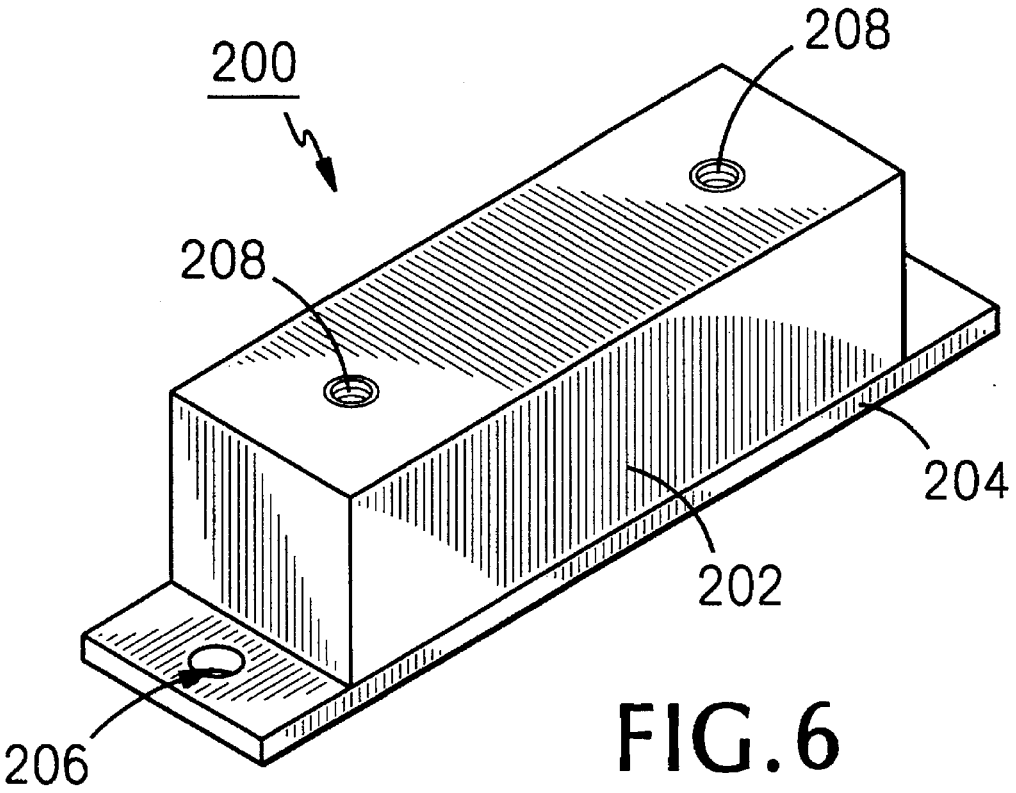
FIG. 6 is an isometric view of alternative vibration isolation means for the bracket of FIG. 1.
Figure 7:
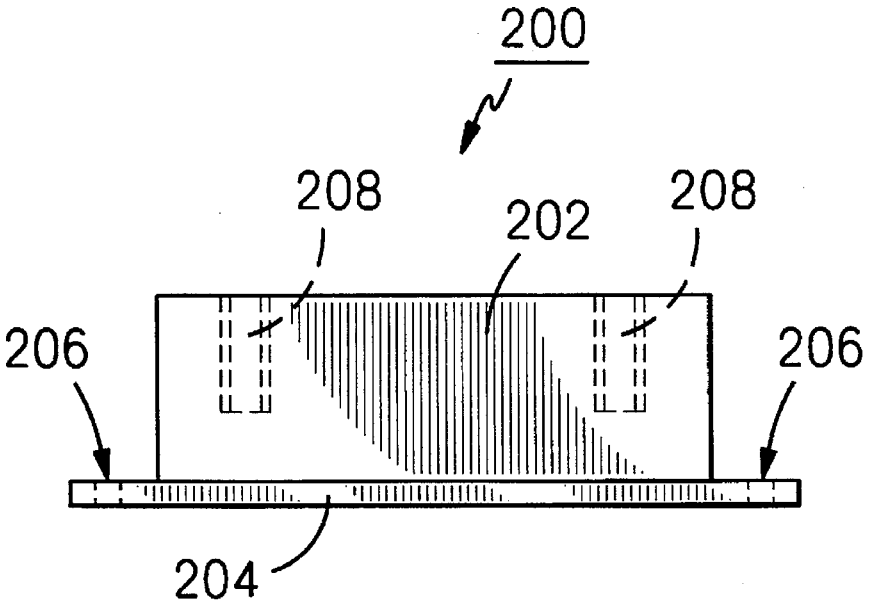
FIG. 7 is a side elevational view of the isolation means of FIG. 6.

FIGS. 6 and 7 illustrate an alternative vibration isolation mount for use with bracket 20, the mount being generally indicated by the reference numeral 200. The use of vibration isolation pads 84 and 86 requires a relatively rigid connection of screws 72 or 74 from horizontal support member 22 (FIG. 1) to window sill 100 (FIG. 2). Mount 200 provides for more complete vibration isolation by including a block of resilient material 202 fixedly disposed on a metallic base member 204. Base member 204 is screwed to window sill 100 through holes 206 defined in the base member. Then, the proximal end of horizontal support member 22 is attached to block 202 by bolts (not shown) inserted into vertical, threaded metallic inserts 208 molded into block 202. Thus, there is no solid path for the transmission of vibrations from window air conditioner 102 to window sill 100.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A mounting bracket for support of a window air conditioner on a window sill installed in a window opening in a wall of a building, said bracket comprising:

(a) a generally horizontal support member for supporting a portion of said window air conditioner extending outside of said building, a proximal end of said generally horizontal support member being for attachment to said window sill;

(b) a foot member to rest against an outside surface of said wall below said window opening;

(c) a strut member having an upper end thereof attached to an attachment point near a distal end of said generally horizontal support member and a lower end thereof attached to said foot member; and (d) means to selectively adjust height of said proximal end of said generally horizontal support member above said window sill, depending on construction of said window sill and obstacles in said window.

2. A mounting bracket, as defined in claim 1, wherein: said strut member is rotatably attached to said distal end of said generally horizontal support member and downward rotation of said lower end of said strut member is terminated by means of beveled ends of side edges of said strut member engaging a lower surface of said generally horizontal support member.

3. A mounting bracket, as defined in claim 2, wherein: said foot member is to rest against said outside surface of said wall without any fasteners inserted into said outside surface of said wall.

4. A mounting bracket, as defined in claim 1, wherein: said means to selectively adjust height include one or more elements selected from the group consisting of spacers and vibration isolation pads.

5. A mounting bracket, as defined in claim 1, further comprising: level indicating means integrally disposed on said bracket to indicate angle from horizontal of said generally horizontal support member.

6. A mounting bracket, as defined in claim 1, wherein: angle from horizontal of said generally horizontal support member is determined by selectively adjusting distance of said attachment point from said distal end of said horizontal support member.

7. A mounting bracket, as defined in claim 1, further comprising: means to isolate, from said wall of said building, vibration caused by operation of said window air conditioner.

8. A method of mounting a window air conditioner with a bracket attached to a window sill installed in a window opening in a wall of a building, said method comprising:

(a) providing a generally horizontal support member for supporting a portion of said window air conditioner extending outside of said building and attaching a proximal end of said generally horizontal support member to said window sill;

(b) providing a foot member resting against an outside surface of said wall below said window opening;

(c) providing a strut member having an upper end thereof attached to an attachment point near a distal end of said generally horizontal support member and a lower end thereof attached to said foot member;

(d) selectively adjusting height of said proximal end of said generally horizontal support member above said window sill, depending on construction of said window sill and obstacles in said window;

(e) selectively adjusting angle from horizontal of said generally horizontal support member by adjusting distance of said attachment point from said distal end of said generally horizontal support member; and (f) placing said window air conditioner on said generally horizontal support member.

9. A method, as defined in claim 8, further comprising: providing said strut member rotatably attached to said distal end of said horizontal support member and downward rotation of said lower end of said strut member is terminated by means of beveled ends of side edges of said strut member engaging a lower surface of said horizontal support member.

10. A method, as defined in claim 9, further comprising: providing said foot member to rest against said outside surface of said wall without any fasteners inserted into said outside surface of said wall.

11. A method, as defined in claim 8, wherein: said step of selectively adjusting height includes selecting one or more elements from the group consisting of spacers and vibration isolation pads.

12. A method, as defined in claim 8, further comprising: employing level indicating means integrally disposed on said bracket to indicate angle from horizontal of said horizontal support member.

13. A method, as defined in claim 8, further comprising: providing vibration isolation means to isolate, from said wall of said building, vibrations caused by operation of said window air conditioner.

14. A mounting bracket for support of a window air conditioner on a window sill installed in a window opening in a wall of a building, said bracket comprising:

(a) a generally horizontal support member for supporting a portion of said window air conditioner extending outside of said building, a proximal end of said generally horizontal support member being for attachment to said window sill;

(b) a foot member to rest against an outside surface of said wall below said window opening;

(c) a strut member having an upper end thereof attached to an attachment point near a distal end of said generally horizontal support member and a lower end thereof attached to said foot member, said strut member being rotatably attached to said distal end of said generally horizontal support member and downward rotation of said lower end of said strut member being terminated by means of beveled ends of side edges of said strut member engaging a lower surface of said generally horizontal support member; and (d) means to selectively adjust height of said proximal end of said generally horizontal support member above said window sill, depending on construction of said window sill and obstacles in said window.

15. A mounting bracket, as defined in claim 14, wherein: said foot member is to rest against said outside surface of said wall without any fasteners inserted into said outside surface of said wall.

16. A method of mounting a window air conditioner with a bracket attached to a window sill installed in a window opening in a wall of a building, said method comprising:

(a) providing a generally horizontal support member for supporting a portion of said window air conditioner extending outside of said building and attaching a proximal end of said generally horizontal support member to said window sill;

(b) providing a foot member resting against an outside surface of said wall below said window opening;

(c) providing a strut member having an upper end thereof attached to an attachment point near a distal end of said generally horizontal support member and a lower end thereof attached to said foot member, said strut member being rotatably attached to said distal end of said horizontal support member and downward rotation of said lower end of said strut member being terminated by means of beveled ends of side edges of said strut member engaging a lower surface of said horizontal support member;

(d) selectively adjusting height of said proximal end of said generally horizontal support member above said window sill, depending on construction of said window sill and obstacles in said window;

(e) selectively adjusting angle from horizontal of said generally horizontal support member by adjusting distance of said attachment point from said distal end of said generally horizontal support member; and (f) placing said window air conditioner on said generally horizontal support member.

17. A method, as defined in claim 16, further comprising: providing said foot member to rest against said outside surface of said wall without any fasteners inserted into said outside surface of said wall.

* * * * *